US009259112B2

(12) United States Patent
Bateman

(10) Patent No.: US 9,259,112 B2
(45) Date of Patent: Feb. 16, 2016

(54) CUP HOLDER

(71) Applicant: Alison Bateman, Surrey (GB)

(72) Inventor: Alison Bateman, Surrey (GB)

( * ) Notice: Subject to any disclaimer, the term of this patent is extended or adjusted under 35 U.S.C. 154(b) by 0 days.

(21) Appl. No.: 14/401,065

(22) PCT Filed: May 16, 2013

(86) PCT No.: PCT/GB2013/051266

§ 371 (c)(1),
(2) Date: Nov. 13, 2014

(87) PCT Pub. No.: WO2013/171496

PCT Pub. Date: Nov. 21, 2013

(65) Prior Publication Data

US 2015/0150398 A1 Jun. 4, 2015

(30) Foreign Application Priority Data

May 16, 2012 (GB) ..... 1208801.9

(51) Int. Cl.
*A47J 45/00* (2006.01)
*A47G 23/02* (2006.01)
*A45F 5/10* (2006.01)

(52) U.S. Cl.
CPC ..... *A47G 23/0208* (2013.01); *A45F 5/10* (2013.01); *A47G 23/0216* (2013.01); *A45F 2005/1013* (2013.01)

(58) Field of Classification Search
CPC ..... B65D 25/32; B65D 25/28; B65D 3/28; B65D 81/3869; A47J 45/071; A47J 45/077; A47J 45/10; A47G 23/0216; A47G 1/17; A47G 23/024; A47G 7/047; A47G 23/0208; F16B 47/00; A61M 5/1417; G09F 3/10; A45F 2005/1073; A45F 5/10; A45F 2005/1013
USPC ..... 294/31.2
See application file for complete search history.

(56) References Cited

U.S. PATENT DOCUMENTS

| | | | | |
|---|---|---|---|---|
| 2,194,898 | A | 3/1940 | Hanford | |
| 3,623,633 | A * | 11/1971 | Kinn | 220/754 |
| 4,022,416 | A * | 5/1977 | Kaye et al. | 248/318 |
| 4,763,833 | A * | 8/1988 | Stoll | 229/117.12 |

(Continued)

FOREIGN PATENT DOCUMENTS

| | | |
|---|---|---|
| DE | 1260364 | 2/1968 |
| DE | 20 2009 015759 | 1/2011 |

(Continued)

OTHER PUBLICATIONS

References: US and foreign # 2 and 5-7 were cited in the International Search Report of the corresponding International Application PCT/GB2013/051266 dated Aug. 21, 2013.

*Primary Examiner* — Stephen Vu
(74) *Attorney, Agent, or Firm* — Cowan, Liebowitz & Latman, P.C.; Mark Montague

(57) ABSTRACT

A cup holder comprises a collar and a handle. The collar comprises a loop of flexible sheet material which extends, in use, around and engages the outer surface of a cup. The handle comprises an elongate strip of flexible sheet material whose ends are connected to the collar at positions which are in use, diametrically opposed. Each end portion of the handle has first and second preformed fold lines formed in it. The first fold line extends perpendicular to the length of the handle along the line where the handle meets the collar. The second fold line extends transversely across the handle at an angle of substantially 45° to its length from a first point where one side edge of the handle meets the collar to a second point spaced from the collar on the other side edge of the handle.

4 Claims, 3 Drawing Sheets

(56) References Cited

U.S. PATENT DOCUMENTS

| | | | | | |
|---|---|---|---|---|---|
| 5,135,125 | A | * | 8/1992 | Andel et al. | 215/399 |
| 5,823,503 | A | * | 10/1998 | Wasserman | 248/683 |

FOREIGN PATENT DOCUMENTS

| | | | |
|---|---|---|---|
| GB | 2078500 | A | 1/1982 |
| GB | 2 366 278 | A | 3/2002 |
| GB | 2471872 | A | 1/2011 |
| GB | 2472591 | A | 2/2011 |
| GB | 2481972 | | 1/2012 |
| JP | 2005-074087 | A | 3/2005 |
| JP | 2008-080072 | A | 4/2008 |
| KR | 20110051986 | | 5/2011 |
| WO | 2007/100772 | A2 | 9/2007 |

* cited by examiner

CUP HOLDER

CROSS REFERENCE TO RELATED APPLICATIONS

This is a U.S. national phase of application No. PCT/GB2013/0512966 filed on May 16, 2013. Priority under 35 U.S.C. §119(a) and 35 U.S.C. §365(b) is claimed from British Patent Application No. 1208801.9, filed on May 16, 2012.

FIELD OF THE INVENTION

The present invention relates to cup holders, that is to say to holders for beverage cups. The invention is particularly concerned with holders for beverage cups of the type which are of upwardly divergent frusto-conical shape and these are typically made of waxed paper or card and are commonly used in cafes and the like for the sale of beverages, particularly hot beverages, such tea, coffee or soup for consumption on or off the premises.

BACKGROUND OF THE INVENTION

Such cups are very advantageous because they are cheap and effective and they can readily be formed into nested stacks and thus require relatively little storage space. They are also biodegradable, in contrast to cups made of plastic material. However, they are not very easy to carry due to the fact that they are flexible and structurally weak and spillages therefore frequently occur. This problem is exacerbated when the beverage to be served is hot because the thermal insulation properties of such cups are relatively poor. Purchasers therefore frequently burn their fingers when carrying such cups filled with the hot beverage and this is not only uncomfortable but also increases the problem of spillages occurring.

In order to obviate these problems, it is known to use a holder or tray of folded cardboard material, which defines a number of recesses for accommodating cups. This largely obviates the problem of burning one's fingers when the cups are filled with a hot beverage but the trays have to be manually folded from flat cardboard blanks and this is quite time-consuming. Further more, the tray blanks have to be stored and many retail outlets simply do not have the storage space available for such relatively bulky articles. Finally, the trays are generally disposed of after being used only once and this means that they add considerably to the overhead expenses of the retail outlet in question and also represent an unacceptable environmental burden in that they must all be subsequently disposed of in a landfill or alternatively recycled.

The above problems are at least partially overcome by the cup holder disclosed in GB2471872. This cup holder comprises a collar and a handle and the collar is a continuous loop of flexible sheet material in which two opposed holes are formed and which, in use, extends around and engages the outer surface of a cup. The handle comprises an elongate strip of flexible sheet material, integral with each end of which are two elongate lugs which extend divergently. The maximum distance between the outer edges of the lugs is greater than the maximum dimension of the holes in the direction of the length of the collar. The width of each lug is less than the said maximum dimension of the holes. The two ends of the handle are pivotally received in respective holes with the two lugs on one side of the collar and the adjacent portion of the handle being on the other side of the collar. Such a cup holder is associated with a considerable advantage by comparison with the known holder or tray referred to above, not least because it is considerably less bulky and therefore occupies very much less storage space and maybe disposed of more simply and cheaply. However, this known cup holder comprises two separate components and these have to be assembled. This is done by folding one of the lugs at each end of the handle over onto the other lug, passing the two lugs together through the associated hole in the collar and then unfolding the two lugs. The fact that the width of the two lugs in the unfolded state is greater than the diameter of the whole means that the handle is pivotally retained on the collar. However, the assembly process must in general be performed in the retail outlet, this is to say only shortly before the cup holder is used, because it is not readily possible to store such cup holders in an assembled state.

OBJECT AND SUMMARY OF THE INVENTION

It is therefore the object of the present invention to provide a cup holder which can be provided in an assembled and ready to use state, thereby saving time for the retailer or the like and it is a further object to provide such a cup holder which comprises only a single piece of material.

According to the present invention, a cup holder comprises a collar and a handle, the collar comprising a loop of flexible sheet material which extends, in use, around and engages the outer surface of a cup, the handle comprising an elongate strip of flexible sheet material whose ends are connected to the collar at positions which are, in use, diametrically opposed, each end portion of the handle having first and second preformed fold lines formed in it, the first fold line extending substantially perpendicular to the length of the handle substantially along the line where the handle meets the collar and a second fold line extending transversely across the handle at an angle of substantially 45° to its length from a first point where one side edge of the handle meets the collar to a second point spaced from the collar on the other side edge of the handle.

Accordingly, in the cup holder of the present invention each end portion of the handle is provided with first and second preformed fold lines. The first fold line extends generally perpendicular to the length of the handle at or very close to the line where the handle meets the collar and this line therefore extends substantially parallel to the plane of the collar. The second fold line extends from a position at or very close to one end of the first fold line at an angle of substantially 45° to the length of the handle to a point on the other side of the handle and spaced from the collar. The term "preformed fold line" is used herein to indicate a line of weakness along which the handle will fold when appropriate force is applied to it. The presence of a line of weakness will result in a reduced bending strength along the line and this means that when a force is applied to the handle it will inherently bend at the preformed lines and not elsewhere. Accordingly, when a downward force is applied to the handle, it will initially buckle somewhat and will then bend or fold along the second fold lines. As it does so, it will bend or fold also about the first fold lines and since the two fold lines are inclined to one another at substantially 45° the effect of this is that the handle will move pivotally from an operative position, in which it extends substantially perpendicular to the plane of the collar, into an inoperative or stowed position, in which it extends substantially parallel to the plane of the collar. As a result of the fact that the first fold lines are formed at least substantially along the line at which the handle meets the collar, when the handle is in the inoperative position its uppermost edge will lie substantially in the same plane as the uppermost edge of the collar. When it is desired to move the handle from the inoperative position to the operative position, an upward force is applied to the outer end of the handle whilst restraining the collar and the effect of this is that the handle then moves again pivotally until it again extends substantially perpendicularly to the plane of the collar. It is found in practice that the resilience of the strip material of the handle is such that the handle is quasi-bistable, that is to say the handle is in equilibrium when in either the operative or inoperative position but when positioned at a position between the operative and inoperative positions, the inherent elasticity of the material will urge the handle into the closest of the operative and inoperative positions.

The fact that the handle is movable between operative and inoperative positions is associated with two quite different advantages. The first is that whilst the cup holder will always be used with the handle in the operative position, when it is in the inoperative position, the handle is more compact and thus easier to store. Secondly, when the handle is in the operative position, it is not readily possible to insert a beverage cup into it, at least without tilting the cup to an angle which will run the risk of spilling the contents of the cup, whereas once the handle has been moved to the inoperative position, a cup may readily be inserted into the collar, whereafter the handle is returned to its operative position to allow it to be used to carry the cup.

When the handle is moved between the operator and inoperative positions, the triangular portions at each end of the handle defined by the first and second fold lines inherently pivot outwards and this movement is accommodated by bending of the handle along two lines which extend generally perpendicular to the length of the handle and which pass generally through the solid second points. In order to facilitate this bending it is preferred that each end portion of the handle is provided with a third preformed fold line which extends generally perpendicular to the length of the handle and passes through or very near to the said second point.

The collar and handle may be made of a number of different flexible sheet materials but it is found that a particularly cheap and effective material is stiff paper or card. The preformed fold lines may also take a number of different forms and one possibility is that at least the first and second fold lines constitute a line of perforations or alternatively a line of slits extending through or at least partially through the handle separated by lands of un-severed material. The preformed fold lines could also be constituted by creases formed in the handle since such creases will also constitute lines of weakness, that is to say lines of reduced bending strength. It is preferred that the third fold lines constitute such preformed crease lines. It is, however, found to be particularly effective if the first and second preformed fold lines are formed by cutting partially through the paper or card material from the outwardly facing surface along the line. Since the handle will inherently have a reduced bending strength along the lines of reduced thickness, when a force is applied to the handle it will inherently bend along the preformed lines.

The collar and handle could be separate components which are subsequently connected together but such connections would necessitate an additional step in the manufacture, that is to say a step in which each end of the handle is connected to the collar by adhesive, stapling or the like and in order to facilitate manufacture it is preferred that the cup holder constitutes a single piece of material and the two ends of the handle are thus integrally connected to the collar. In this event, the cup holder would be formed from a single blank of material cut to shape and the two ends of the collar will then have to be connected together, e.g. by adhesive, stapling or the like. The handle of such a blank would then inherently be in two separate portions, each of which has one end integrally connected to the collar the other end of which is free. These two free ends will then have to be connected together, again by adhesive, stapling or the like.

The cup holders in accordance with the invention are preferably stored in the inoperative position so as to occupy the minimum space. This will involve folding the collar at two separate positions and these positions are preferably offset from the two positions at which the handle is connected to it by substantially 90°. A fold will also necessarily be formed in the handle and this will be along a line perpendicular to its length midway between its two ends. These folds could first be formed when packing the cup holders or the cup holder could be provided with preformed creases at the appropriate positions to facilitate folding and packing of the cup holder.

Further features and details of the invention will be apparent from the following description of one specific embodiment of cup holder in accordance with the invention, which is given by way of example only with reference to the accompanying drawings, in which:

DETAILED DESCRIPTION OF THE INVENTION

Figure 1:
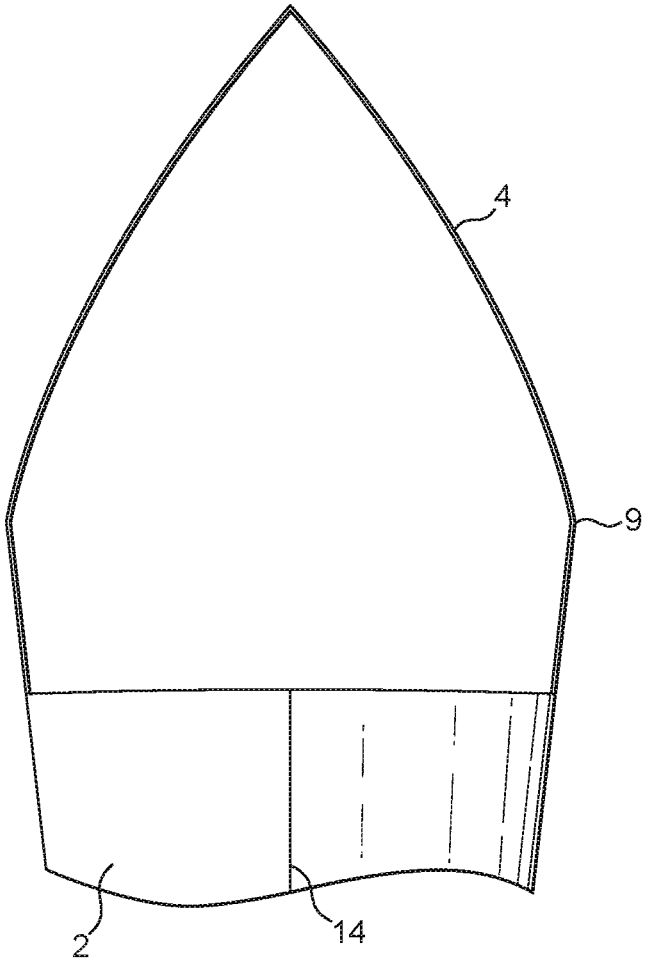
FIG. 1 is a side view of the cup holder in accordance with the invention with the handle in the operative position.
Figure 2:
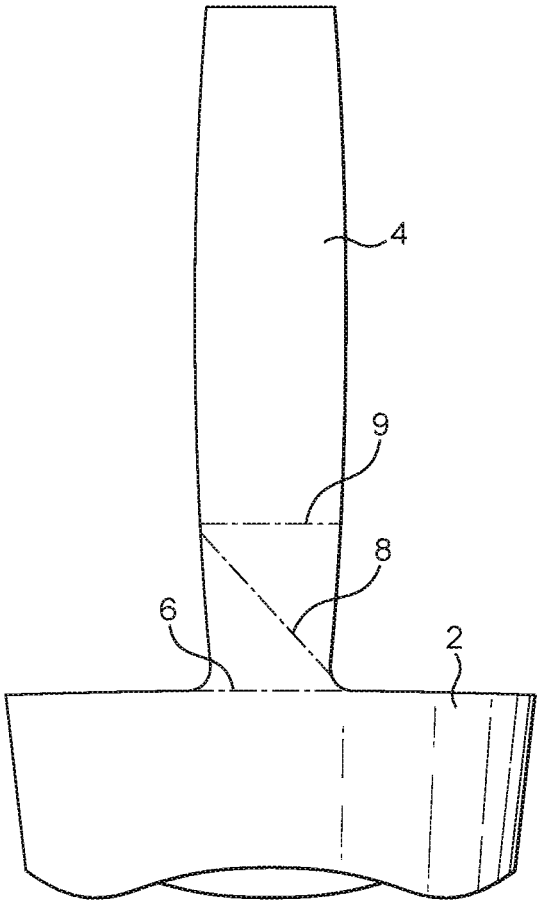
FIG. 2 is a side view of the cup holder of FIG. 1 seen in a direction at right angles to that of FIG. 1.
Figure 3:
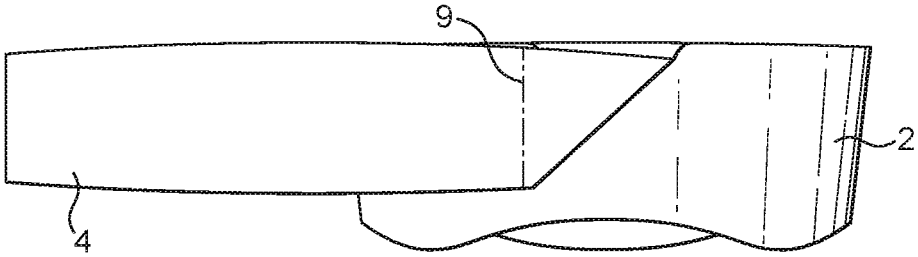
FIG. 3 is a side view of the cup holder in the inoperative position.

Referring firstly to FIGS. 1 to 3, it will be seen that the cup holder comprises a collar 2 in the form of a substantially circular loop. Integrally connected to the upper edge of this loop 2 are the two ends of a handle 4. Both the loop and handle are made of flexible sheet material, which in this case is waxed card. Formed at the junction of each end of the handle 4 with the collar 2 is a first preformed fold line 6, which extends perpendicular to the length of the handle 4 and parallel to the plane of the collar 2. Also extending across the handle at each end portion is a second preformed fold line 8, which extends from a first point at one end of the associated first fold line 6 to a second point on the opposite side of the handle 4 at an angle of 45° to the length of the handle 4 and also to the plane of the collar 2. A third fold line 9 is also provided, which extends generally parallel to the first fold line 6 and passes through or very close to the second point. The preformed fold lines may be formed in a number of ways but in this case the first and second fold lines are constituted by cuts inwardly from the outwardly facing surface of the handle through a proportion of the thickness of the handle. The third fold lines preferably constitute preformed creases in the card material. Each fold line therefore constitutes a line of reduced bending strength. In the operative position shown in FIGS. 1 and 2, the handle 4 extends upwardly at right angles to the plane of the collar 2. If, however, it should be desired to move the handle 4 into the inoperative position shown in FIG. 3, the collar 2 is grasped in one hand and a force acting generally downwards and to the left, as seen in FIG. 2, is applied to the handle 4. This results in folding of the handle 4 about the two fold lines 6, the two fold lines 8 and the two fold lines 9 simultaneously and the handle 4 therefore moves progressively in a quasi-pivotal motion into the position shown in FIG. 3 in which the upper edge lies in substantially the same plane as the upper edge of the collar 2. This is the configuration in which the cup holder will be stored and for this purpose two creases or fold lines will be formed in the collar at diametrically opposed positions offset by substantially 90° from the positions at which the handle 4 is connected to the collar 2. A further crease or fold line will also be formed in the handle at a point midway between its ends. If it desired to move the handle from the inoperative position shown in FIG. 3 to the operative position shown in FIGS. 1 and 2, the collar is grasped with one hand and an upward force, as seen in FIG. 3, is applied to the free end of the handle 4 and this results in quasi-pivotal movement in the opposite direction and simultaneous straightening of the handle 4 about the fold lines 6, 8 and 9. In practice, it is found that the handle exhibits a degree of bistability and thus once the handle has been moved manually up to a position in which it extends at 45° or more to the plane of the collar 2, the natural resilience of the material of the handle, which is of course deformed at the fold lines 6, 8 and 9, exerts a sufficient force to return the handle to the upright position shown in FIGS. 1 and 2.

In use, the cup holder is stored flat in the inoperative position shown in FIG. 3. When it is desired to use the holder to hold a beverage cup, the lower end is of the beverage cup is passed through the holder from above until the collar 2 is a tight fit around the periphery of the cup. An upward force is then applied to the free end of the handle 4 to move it into the operative position shown in FIGS. 1 and 2. The handle may then be used to carry the cup without the user having to contact the cup itself at all.

Figure 4:
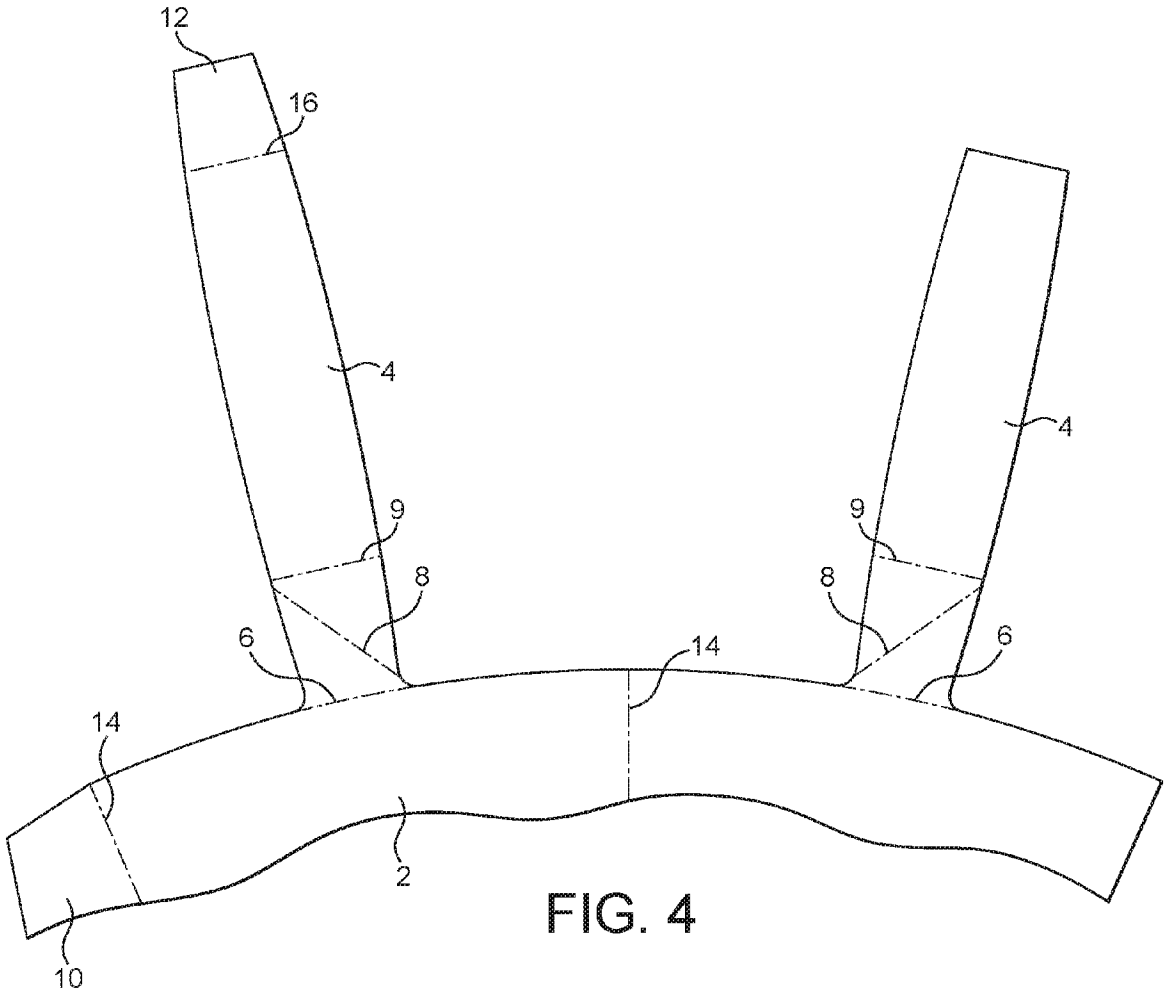
FIG. 4 is a view of the blank from which the cup holder is made.

The cup holder in accordance with the invention may be made in a number of ways but it is preferred that it is made from a single blank of flexible material, as shown in FIG. 4. FIG. 4 shows the blank in flat form after having been stamped out of a large sheet of material or cut from it in some other way. After the blank has been formed it is perforated, creased or partially cut through to form the fold line 5, 6, 8 and 9. The collar is then formed into a circular shape and the tongue 10 at one end of it is connected to the other end of it, conveniently by adhesive. As will be seen, the two strips of material which will form the handle 4 are of slightly different length, one of the strips having a tongue 12 at its remote end. This tongue is then connected to the free end of the other handle portion, again preferably by adhesive. The cup holder is then complete and for transport and storage purposes the handle 4 will generally be folded as described above into the inoperative position. The cup holder will generally be stored in a flat configuration and when it is flattened two fold lines 14 will be formed in the collar 2 and a further fold line 16 will be formed in the handle 4. These fold lines may be formed when the cup holder is first pressed into the flat configuration or alternatively these fold lines maybe preformed by creasing so as to facilitate folding of the cup holder into the flat configuration and to ensure that the cup holder occupies the minimum amount of space.

The invention claimed is:

1. A cup holder comprising a collar and a single handle, said collar comprising a loop of flexible sheet material which extends, in use, around and engages the outer surface of a cup, said handle having a length and comprising an elongate strip of flexible sheet material have two end portions, said end portions being connected to the loop of the collar at positions which are, in use, diametrically opposed across the loop, each said end portion of said handle having first and second preformed fold lines formed in it, said first fold line extending substantially perpendicular to the length of said handle substantially along the line where said handle meets said loop of said collar and said second fold line extending transversely across said handle at an angle of substantially 45° to the length of said handle from a first point where one side edge of said handle meets said loop of said collar to a second point spaced from said collar on another side edge of said handle, and wherein the single handle is moveable between an operative position to allow it to be used to carry a cup and an inoperative position.

2. A cup holder as claimed in claim 1, in which each said end portion also has a third preformed fold line formed in it extending substantially perpendicular to the length of said handle and substantially through said second point.

3. A cup holder as claimed in claim 1, in which said collar and said handle are made of paper or card material and said first and second preformed fold lines are formed by cutting partially through the thickness of said paper or card material from its outwardly facing surface along the line.

4. A cup holder as claimed in claim 1, which constitutes a single piece of material and said two end portions of said handle are thus integrally connected to said collar.

* * * * *